United States Patent [19]

Pangburn

[11] Patent Number: 4,468,027

[45] Date of Patent: Aug. 28, 1984

[54] MINIATURE BASKETBALL BACKBOARD ASSEMBLY ATTACHABLE TO A DOORFRAME, DOOR, OR THE LIKE

[76] Inventor: Charles A. Pangburn, 4635 Seven Hills Rd., Evansville, Ind. 47711

[21] Appl. No.: 444,621

[22] Filed: Nov. 26, 1982

[51] Int. Cl.[3] ..... A63B 63/08

[52] U.S. Cl. ..... 273/1.5 R

[58] Field of Search ..... 273/1.5 R, 1.5 A; 248/560, 614, 634, 208, 220.1; 211/86, 87

[56] References Cited

U.S. PATENT DOCUMENTS

| | | | |
|---|---|---|---|
| 2,512,417 | 6/1950 | Cook | 273/1.5 R X |
| 3,244,420 | 4/1966 | Poynter | 273/1.5 A X |
| 4,183,522 | 1/1980 | Killen | 273/1.5 R |

*Primary Examiner*—Paul E. Shapiro

[57] ABSTRACT

A miniature basketball backboard assembly which attaches to a door frame or the like for indoor use and specifically for use in areas with space limitations preventing play of the full scale game. A horizontal transom brace includes a flange portion which extends horizontally over the ledge of a transom, and is fixedly attached to the transom by tacks which are nailed through holes in the transom flange and into the transom. A transom backing extends downward from the transom flange between the backboard and the transom. The backboard is attached to the transom backing by nylon screws which are placed through holes in the backboard and into threaded holes in the transom backing. The nylon backing both protects the door frame structure and improves the sturdiness and durability of the mounted backboard. A second brace (jamb brace) includes a jamb flange which extends vertically and is placed against the side edge of a jamb. The jamb brace is fixedly attached to the jamb by tacks which are nailed through holes in the jamb flange and into the side of the jamb. A nylon jamb backing extends horizontally from the jamb flange between the backboard and the jamb. The backboard is firmly fixed to the jamb backing by a nylon screw which is placed through a hole in the backboard and threaded into a threaded hole in the jamb backing.

5 Claims, 5 Drawing Figures

MINIATURE BASKETBALL BACKBOARD ASSEMBLY ATTACHABLE TO A DOORFRAME, DOOR, OR THE LIKE

BACKGROUND OF THE INVENTION

1. Field of the Invention

The field of the invention is miniature basketball backboards assemblies.

2. Brief Description of the Prior Art

Basketball, a favorite pastime in this country for over a century, is a game in which points are scored by shooting a ball through a horizontally positioned hoop commonly known as a basket. The basket extends from a backboard which has a vertical surface that is sometimes used as a indirect target for "banking" the ball into the basket.

In a standard sized game, the basket is positioned 10 feet above the floor. Because of the space required to play the game, it is played either outdoors or in a gymnasium which is large enough to accomodate a basketball playing area.

Miniature basketball backboard assemblies have been made which bring some of the enjoyment of the game indoors. For example, miniature backboards have been mounted to independent stands which can be placed where there is appropriate space within a room. In another indoor basketball device, a miniature hoop is mounted to an inverted U shaped channel member which is placed over the top of a door. Such devices typically fail to provide sufficient sturdiness during play. Alternatively, indoor miniature basketball mountings of a more permanent nature may tend to disfigure or damage, or otherwise require noticeable modification to the existing indoor structure to which they may be mounted.

SUMMARY OF THE INVENTION

The present invention relates to a miniature basketball backboard assembly for indoor use and specifically for use in areas with space limitations preventing play of the full scale game. In one embodiment, the backboard assembly attaches to a door frame. A horizontal transom brace includes a flange portion which extends horizontally over the ledge of a transom, and is fixedly attached to the transom by tacks which are nailed through holes in the transom flange and into the ledge of the transom. A transom backing extends downward from the transom flange between the backboard and the transom. The backboard is attached to the transom backing by shock absorbant (nylon) screws which are placed through holes in the backboard and threaded into threaded holes in the shock absorbant (nylon) transom backing. The nylon transom backing both protects the surface of the door frame and contributes to the sturdiness and durability to the mounting. A second brace (jamb brace) includes a jamb flange which extends vertically and is placed against the side edge of a jamb. The jamb brace is fixedly attached to the jamb by tacks which are nailed through holes in the jamb flange and into the side of the jamb. A nylon jamb backing extends horizontally from the jamb flange between the backboard and the jamb. The backboard is firmly fixed to the jamb backing by a nylon screw which is placed through a hole in the backboard and threaded into a threaded hole in the jamb backing.

DESCRIPTION OF THE PREFERRED EMBODIMENT

Figure 1:
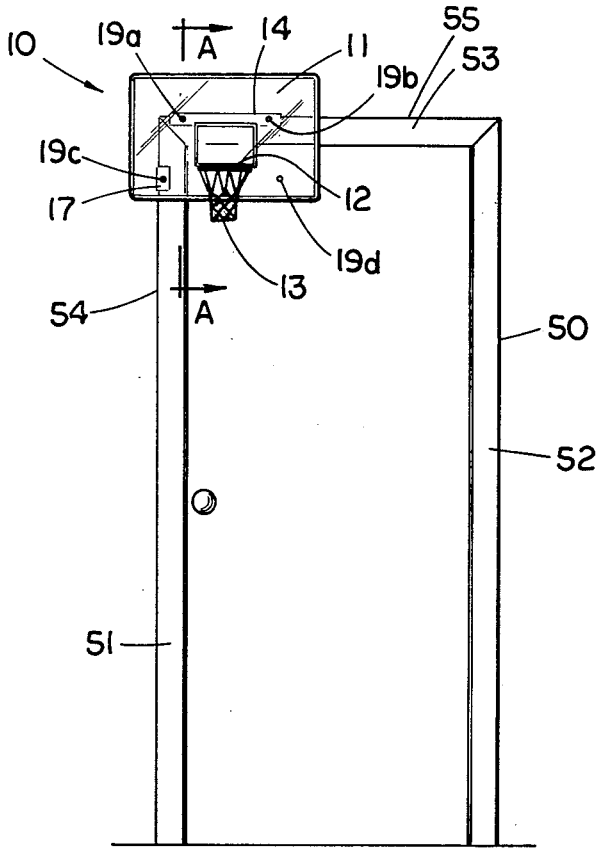
FIG. 1 is a front elevational view of a basketball backboard assembly of the present invention attached to a door frame.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings, FIG. 1 shows a basketball backboard assembly 10 attached to a door frame 50, the door frame 50 including jambs 51 and 52, and transom 53. Backboard 11 is scaled down from the full sized standard basketball backboard and is preferably made of clear acrylic material. Basketball hoop 12 extends horizontally from backboard 11 and is made of welded steel. Basketball hoop 12 is attached to backboard 11 by anchoring screws **12*a*. Hanging from hoop 12 is net 13 through which a shot ball will pass when it has been shot through hoop 12 to score a goal. The preferred size for the scaling down of backboard 11 and hoop 12** is to that of a tennis ball, approximately a scale of 4 or 5 to 1.

Transom brace 14 attaches to backboard 11 by screws **19*a*, and 19*b* which pass through holes in backboard 11 and into threaded holes in brace 14. Transom brace 14 is, in turn, fixedly attached to ledge 55 of transom 53 by tacks 16 (see FIG. 3) which are nailed through holes in transom brace 14 and into ledge 55. Jamb brace 17 attaches to backboard 11 by screw 19*c* which passes through a hole in backboard 11 and into a threaded hole in brace 17. Jamb brace 17 is, in turn, fixedly attached to the side edge 54 of jamb 51 by tacks 18 (see FIG. 3) which are nailed through holes in jamb brace 17 and into side edge 54. Backboard 11 also has hole 19*d* which is available for inverted mounting on the opposite side of a door frame than that shown in FIG. 1**.

Figure 3:
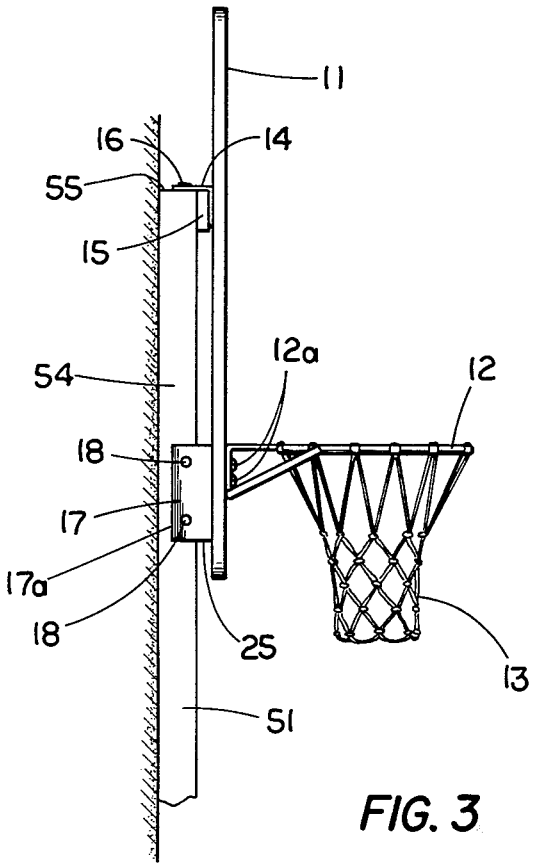
FIG. 3 is a fragmentary, side elevational view of FIG. 1.

In FIG. 3 the manner of attachment of backboard 11 to door frame 50 can be more clearly seen. Tacks 16 are nailed through holes in flange portion **14*a* of transom brace 14 (three have been found to be sufficient). Backing portion 15 of transom brace 14 extends downwardly from flange portion 14*a* between transom 53 and backboard 11, and includes shock absorbant material, most preferably nylon. Tacks 18 are nailed through holes in flange portion 17*a* of jamb brace 17** and into side edge 55 of jamb 51. Jamb brace 17 also includes nylon backing portion 25 (not shown) between jamb 51 and backboard 11.

Figure 4A:
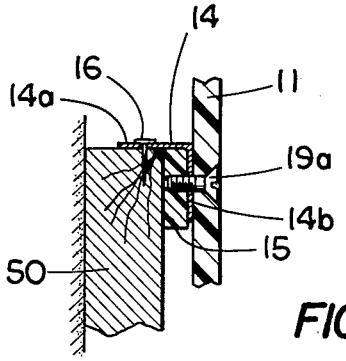
FIG. 4A is a partial fragmentary, partial cross sectional view showing the attachment of backboard mounted to a transom brace and, in turn, the attachment of the transom brace to a door transom, sectioned along line A—A.
Figure 4B:
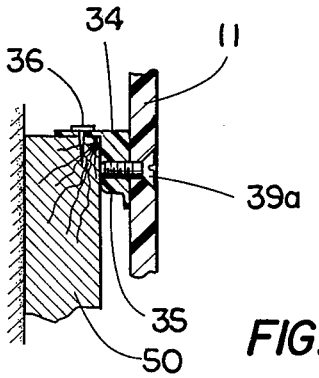
FIG. 4B is a partial fragmentary, partial cross sectional view of an alternative brace structure mounted to a transom and attached to the backboard.

FIG. 4A further shows in detail the manner of attachment of backboard 11 to door frame 50. Backing portion 15, glued to flange 14*b*, defines a threaded hole which receives screw 19*a*. Both backing portion 15 and screw 19*a* are made of shock absorbant material, and most preferably made of nylon. The manner of attachment of backboard 11 to transom brace 14 by screw 19*b* to backing portion 15 and by screw 19*c* to jamb backing portion 25 is the same as that shown for screw 19*a* and transom brace 14 in FIG. 4A. FIG. 4B illustrates another embodiment for the brace structure in which brace 34 is made entirely of nylon. Screw 39*a* is fitted through backboard 11 and into transom backing portion 35 of brace 34. Tacks 36, in turn, attach transom brace 34 to door frame 50.

The miniature basketball backboard mounting assembly, as above described, is easy to mount to any door frame or the like, by its indirect manner of attachment. When mounted, it is securely fastened so that the assembly will withstand the normal expected rigors of play. The normal stress forces applied to the assembly would not tend to work loose the attachment of the braces to the door frame. Even with extended play, the mounting between the braces and the backboard will tend to remain secure because of the nylon attachment. The nylon backing both protects the door frame from damage and contributes to the stability and durability of the mounting. The mounting is not susceptible to causing damage to the door assembly during play, nor does it leave noticable damage or other markings upon removal. The tack holes that may be left on the top ledge of the transom and side edge of the jamb leave only minor, and largely undetectable traces of the prior mounting. Moreover, the assembly is not only easily mounted, and sturdy and durable when mounted, but the backboard can also be temporarily removed within seconds by the removal of three screws.

Figure 2:
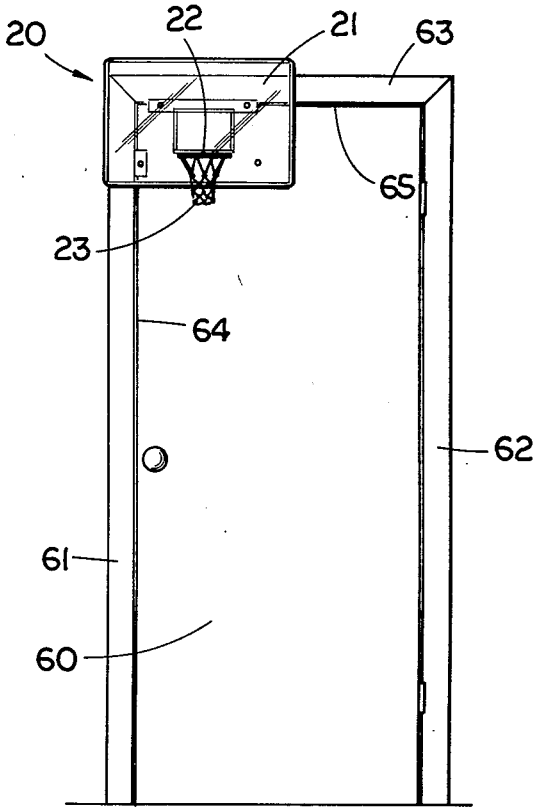
FIG. 2 is a front elevational view of the basketball backboard assembly of FIG. 1 mounted to a door.

FIG. 2 illustrates another backboard assembly 20 of the present invention, including backboard 21, hoop 22 and net 23, which is mounted to the top edge 65 and side edge 64 of door 60. This is sometimes a suitable alternative mounting, particularly where the mounted door opens inwardly, as door 60 does with respect to the door frame (jambs 61, 62, and transom 63). As can be seen from FIG. 2, the same principles of mounting apply. Therefore, while there have been described above the principles of this invention in connection with specific apparatus, it is to be clearly understood that this description is made only by way of an example and not as a limitation to the scope of the invention.

What is claimed is:

1. A miniature basketball backboard assembly attachable to a door frame, door, or the like, said assembly comprising: a backboard, said backboard having a substantially flat vertical surface; a basketball hoop, said hoop being attached to said backboard and extending horizontally therefrom; said backboard having a set of horizontal transom brace holes therethrough positioned along a horizontal line above said hoop, said backboard further having a horizontal jamb brace hole therethrough positioned below said horizontal line; a horizontal transom brace, said horizontal transom brace including a transom flange portion extending horizontally, said transom flange portion having vertical holes therethrough for attachment to the ledge of a transom, said transom brace further including a backing portion, said transom backing portion extending downward from said transom flange portion between said backboard and a transom, said transom backing portion defining a set of horizontal holes for attachment to said backboard, said transom backing set of horizontal holes being aligned with said backboard set of horizontal transom brace holes, said transom backing portion including shock absorbant material; a vertical jamb brace, said vertical jamb brace including a jamb flange portion extending vertically, said jamb flange portion having at least one horizontal hole therethrough for attachment to the side edge of a jamb, said jamb brace further including a jamb backing portion extending horizontally from said jamb flange portion between said backboard and a jamb, said jamb backing portion defining a horizontal hole for attachment to said backboard, said jamb backing portion including shock absorbant material; brace/backboard attachment members, said brace/backboard attachment members being fitted through the holes in said backboard and into the holes in said transom brace and said jamb brace to fixedly attach said backboard to said transom brace and said jamb brace; and frame/brace attachment members fittable through the holes in said transom brace and said jamb brace and into the transom and jamb respectively to fixedly attach said transom brace and said jamb brace to the transom and the jamb respectively.

2. The miniature basketball backboard assembly of claim 1 in which said brace/backboard attachment members are made of shock absorbant material.

3. The miniature basketball backboard assembly of claim 2 in which said shock absorbant material is nylon.

4. The miniature basketball backboard assembly of claim 3 in which said brace/backboard attachment members are nylon screws and in which the holes in said transom backing and said jamb backing are cooperatively threaded, said nylon screws being threadable into the transom backing and backing holes to fixedly and removably attach said backboard to said transom brace and said jamb brace.

5. The miniature basketball backboard assembly of claim 1 in which said shock absorbant material is nylon.

* * * * *